US008079298B2

(12) United States Patent
Allart et al.

(10) Patent No.: US 8,079,298 B2
(45) Date of Patent: Dec. 20, 2011

(54) COMPACT HYDRAULIC MECHANISM WITH RADIAL PISTONS

(75) Inventors: Bernard Allart, Crépy en Valios (FR); Julien Viard, Pontpoint (FR)

(73) Assignee: Poclain Hydraulics Industries, Verberie (FR)

( * ) Notice: Subject to any disclaimer, the term of this patent is extended or adjusted under 35 U.S.C. 154(b) by 536 days.

(21) Appl. No.: 12/305,424

(22) PCT Filed: Jun. 27, 2007

(86) PCT No.: PCT/FR2007/051538

§ 371 (c)(1),
(2), (4) Date: Dec. 18, 2008

(87) PCT Pub. No.: WO2008/017766

PCT Pub. Date: Feb. 14, 2008

(65) Prior Publication Data

US 2009/0288551 A1 Nov. 26, 2009

(30) Foreign Application Priority Data

Jun. 28, 2006 (FR) ..... 06 52680

(51) Int. Cl.

| | |
|---|---|
| ***F03C 1/04*** | (2006.01) |
| ***F03C 1/247*** | (2006.01) |
| ***F03C 1/047*** | (2006.01) |
| ***F04B 1/047*** | (2006.01) |
| ***F04B 1/04*** | (2006.01) |

(52) U.S. Cl. ..... 91/491; 417/273; 92/72

(58) Field of Classification Search ..... 417/273; 92/72; 91/491, 498
See application file for complete search history.

(56) References Cited

U.S. PATENT DOCUMENTS

| | | | | |
|---|---|---|---|---|
| 4,171,732 | A * | 10/1979 | Pinson | 180/308 |
| 5,391,059 | A * | 2/1995 | Hallund | 417/273 |
| 5,855,115 | A * | 1/1999 | Martin | 60/437 |
| 6,199,377 | B1 * | 3/2001 | Allart et al. | 60/439 |

FOREIGN PATENT DOCUMENTS

WO 92/10677 A1 6/1992

OTHER PUBLICATIONS

International Search Report; PCT/FR2007/051538.

* cited by examiner

*Primary Examiner* — Devon C Kramer
*Assistant Examiner* — Ryan Gatzemeyer
(74) *Attorney, Agent, or Firm* — Ladas & Parry LLP

(57) ABSTRACT

A hydraulic mechanism including a cylinder block having radial pistons and mounted to rotate in a stationary casing, and a distribution cover that forms a portion of the casing that has feed and discharge ducts that extend between an outside face and inside of face of the cover. The internal distributor has distribution ducts that are selectively connected to the feed and discharge ducts that open out into a distribution face that is perpendicular to the axis of rotation and that is disposed against the communication face of the cylinder block so as to cause the distribution ducts to communicate with the cylinder ducts. In a zone defined radially outwards by end-wall portions of the cylinders, a transverse face of the cylinder block is provided with an axial setback in which at least a portion of the distributor is disposed.

11 Claims, 3 Drawing Sheets

COMPACT HYDRAULIC MECHANISM WITH RADIAL PISTONS

BACKGROUND OF THE INVENTION

The present invention relates to a hydraulic mechanism such as a motor or a pump comprising a cylinder block that is suitable for rotating about an axis of rotation in a stationary casing and that has a plurality of cylinders in which pistons are disposed that are suitable for co-operating with a cam that is secured to or integral with the casing, the cylinders extending radially relative to the axis of rotation and being connected by cylinder ducts to communication orifices disposed in a communication face of the cylinder block that is perpendicular to the axis of rotation, the motor further comprising a distribution cover that forms a portion of the casing, and an internal fluid distributor that is non-rotary relative to said cover, the cover having feed and discharge ducts that pass through a zone corresponding to an axial projection of the cylinders and that extend between an outside face and an inside face of said cover, the internal distributor having distribution ducts that extend between a connection face that co-operates with said inside face for the purpose of selectively connecting the distribution ducts to the feed and discharge ducts, and a distribution face that is perpendicular to the axis of rotation and that is disposed against the communication face in such a manner as to cause the distribution orifices of said distribution ducts to communicate with the communication orifices while the cylinder block is rotating.

In this type of mechanism, when it is a motor, the drive outlet is formed by a member that is constrained to rotate with the cylinder block. For example, said member is constituted by a portion of the cylinder block that forms a flange that projects beyond the casing and to which an article to be driven can be fastened, or else said member can be constituted by a drive shaft that is constrained to rotate with the cylinder block. In particular, the shaft is engaged in a central bore in the cylinder block and is constrained to rotate therewith by means of fluting.

This type of motor is in very wide use for driving all types of moving member, in particular vehicle displacement members for enabling a vehicle to move.

An analogous mechanism can be used as a pump for feeding a hydraulic circuit with fluid under pressure.

Usually, such mechanisms are used on vehicles and are situated in an environment also occupied by the other parts and members of the vehicle. It is also desirable for the hydraulic connection to be easily accessible, which is why the feed and discharge ducts have their outlets situated in the outside face of the distribution cover.

An object of the present invention is to improve the known state of the art for a hydraulic mechanism of the above-mentioned type, by increasing its compactness.

This object is achieved by means of the fact that, in a zone defined radially outwards by end-wall portions of the cylinders, a transverse face of the cylinder block is provided with an axial setback in which at least a portion of the distributor is disposed, in which portion the distribution face is situated, the communication face being provided in a plane surface of said setback.

The overall axial size of the hydraulic mechanism is reduced by a length corresponding to the depth of the axial setback, advantageous use being made of said setback for receiving a portion of the distributor. This configuration in no way hinders access to the hydraulic connection of the feed and discharge ducts, because said ducts remain situated in the outside face of the distribution cover. It should also be noted that the weight of the mechanism is reduced in proportions corresponding to the weight of material removed from the setback. It should also be noted that the improvement procured by the invention is entirely compatible with the use of a conventional distributor, as explained below, and with, as a drive outlet member of the motor, a shaft engaged in the central bore of the cylinder block, regardless of whether or not said shaft is a through shaft.

Advantageously, the setback extends to a radial plane situated between two transverse planes defined by the envelope of at least some of the pistons. In which case, it is advantageous, at least for the cylinders in which said at least some of the pistons slide, for the cylinder ducts to have duct segments that are offset towards that side of the cylinder block that is opposite from the setback relative to the axes along which the pistons slide.

These configurations make it possible to give the axial setback a depth that is relatively large, thereby improving the compactness of the mechanism.

Advantageously, on its inside face, the distribution cover has an extension that penetrates into the setback.

Thus, a portion of the distribution cover that is necessary for it to co-operate properly with the internal distributor can also be received in the setback, thereby further increasing the compactness of the mechanism.

Advantageously, the extension of the distribution cover and the setback have facing cylindrical faces, between which a rotary bearing is provided.

The rotary bearing can, in particular, comprise a journal bearing or a needle roller bearing. It makes it possible to improve the rigidity of the cylinder block by supporting said cylinder block in the setback, in such a manner as to avoid any tendency, in operation, for the cylinder block to tilt or to deform towards the setback.

BRIEF DESCRIPTION OF THE DRAWING FIGURES

The invention can be well understood and its advantages appear more clearly on reading the following detailed description of embodiments shown merely by way of non-limiting example. The description refers to the accompanying drawings, in which.

DETAILED DESCRIPTION OF THE PREFERRED EMBODIMENTS

For simplification reasons, reference is made below to a hydraulic motor, it being understood that the mechanism described can also be a pump.

Figure 1:
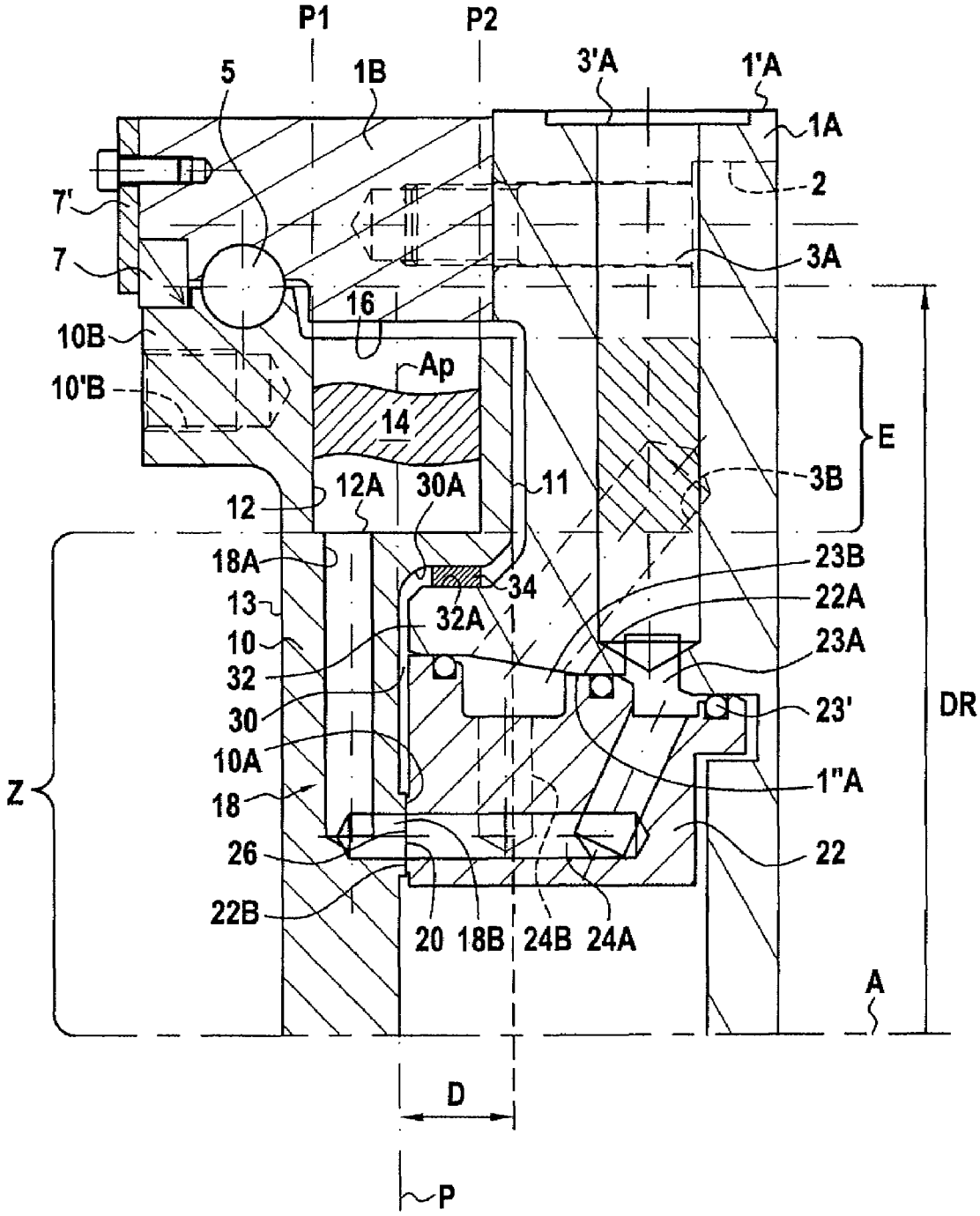
FIG. 1 is a diagrammatic radial half-section view showing a first embodiment of a mechanism of the invention.

The motor of FIG. 1 has a casing in two portions 1A and 1B that are coupled together by fastening screws 2 that are shown in dashed lines. The portion 1A of the casing forms the distribution cover, and has ducts 3A and 3B that extend between the outside face 1'A of the cover 1A and an inside face 1"A of said cover. For example, the duct 3A is a feed duct while the duct 3B is a discharge duct. Naturally, this situation is inverted if the direction of rotation of the cylinder block of the motor changes.

The ducts are isolated from each other, even though, in the example shown, the duct 3B has a radial segment that lies within the same axial footprint as an end portion of the duct 3A. This feature offers the advantage of making it possible to align the connection orifices of said ducts (e.g. the orifice 3'A of the duct 3A) that are situated in the outside face 1'A perpendicularly to the axis of rotation A of the cylinder block in order to facilitate connection to external pipes.

The motor of FIG. 1 also has a cylinder block 10 that is mounted to rotate about the axis A and that has a plurality of cylinders 12 in which pistons 14 (shown in part) are disposed that are suitable for co-operating with the cam 16 which, in this example, is formed on a portion of the inside periphery of the portion 1B of the casing.

The motor of FIG. 1 is a radial-piston motor, the cylinders extending radially relative to the axis A. They are connected by cylinder ducts 18 to communication orifices 20 situated in a communication face 10A of the cylinder block. Said communication face is plane and perpendicular to the axis A.

It can be seen that the feed and discharge ducts pass through a zone E (hatched zone) corresponding to a projection of the cylinders 12 that is made parallel to the axis A.

The motor also has an internal fluid distributor 22 that is non-rotary, i.e. that is prevented from rotating relative to the casing about the axis A. Said distributor has distribution educts 24A, 24B that extend between a connection face 22A and a distribution face 22B of the distributor. The connection face 22A co-operates with the inside face 1"A of the cover 1A for the purpose of selectively connecting the distribution ducts to the feed and discharge ducts. It can thus be seen that the ducts 24A are connected to the duct 3A, while the ducts 24B are connected to the duct 3B. The distribution face 22B is parallel to the communication face 10A of the cylinder block and is disposed against said communication face in such a manner as to cause the distribution orifices 26 of the distribution ducts that are situated in the face 22B to communicate successively with the communication orifices 20 while the cylinder block is rotating.

In the example shown, the internal fluid distributor 22 is of the stepped type. Its connection face 22A presents a stepped outside axial face into which two grooves, respectively 23A and 23B, open out, which grooves are spaced apart axially. As can be seen, when the internal distributor 22 is assembled in the distribution cover 1A, the orifices of the feed and discharge ducts 3A, 3B that are situated in the inside face of said distribution cover are situated in register with respective ones of the grooves 23A and 23B. All of the distribution ducts 24A of a first group are connected to the groove 23A, and all of the distribution ducts 24B of the second group are connected to the groove 23B.

It should be noted that, for reasons of simplification, the distributor that is shown has two groups of distribution ducts and two grooves. Naturally, the distributor could have three or four groups of distribution ducts, in particular if the motor has a plurality of operating cubic capacities, a cubic capacity selector then, in a manner known per se, making it possible to cause some of the grooves to communicate with one another via sealing gaskets 231 co-operating with the inside face 1"A of the distribution cover 1A.

The transverse face 11 of the cylinder block 10, which face is situated on the same side as the side on which the internal distributor 22 is situated, is provided with an axial setback 30 into which a portion of said distributor penetrates. Said setback is situated in a zone Z that is defined radially outwards by the end-wall portions 12A of the cylinders 12. In other words, the setback extends only in a portion of the cylinder block that is situated radially under the cylinders. It can be seen that the communication face 10A of the cylinder block is situated in a plane surface formed at the end-wall of said setback 30.

The internal fluid distributor 22 penetrates into said setback and, similarly, on the same side as its inside face 1"A in co-operation with the connection face of the distributor 22, the distribution cover 1A is provided with an extension 32 that penetrates into the setback. Said extension is, in particular, an annular extension disposed around a portion of the connection face 22A of the distributor. In this example, the extension 32 serves to cover the groove 23B.

It can be understood that, by means of this configuration, the axial length of the motor is reduced to a distance D corresponding to the penetration depth to which the distributor 22 penetrates into the setback, and thus to the depth thereof.

The extension 32 of the distribution cover and the setback 30 have facing cylindrical faces, respectively 32A and 30A, between which a rotary bearing 34 is provided. For example, the rotary bearing is a journal bearing or a needle roller bearing. This bearing is advantageous so as to make it possible, when necessary, to reinforce the rigidity of the cylinder block while taking account of the presence of the setback 30.

Said setback extends inside the face 11 of the cylinder block (i.e. going towards the opposite face 13), to a radial plane P that is situated between two transverse planes P1, P2 defined by the envelope of the pistons.

In this example, it can be observed that the axes Ap along which the piston slide are situated substantially within the plane P defining the end-wall of the setback 30.

In the example shown, the cylinder block has a single row of pistons but it could have a plurality of rows, in which case the planes P1 and P2 between which the plane P extends would be defined by the envelope of the first row of pistons.

It can be seen that the cylinder ducts 18 are offset on the side opposite from the side on which the face 11 of the cylinder block is situated, relative to the axes Ap along which the pistons slide. More precisely, the cylinder duct 18 shown has a segment 18A that extends radially from the end-wall 12A of a cylinder towards the axis A, and a connection segment 18B that connects the communication orifice 20 to the segment 18A, while extending substantially axially. It is the segment 18A that is offset towards the side 13 of the cylinder block that is opposite from the setback 30 relative to the axis Ap. The segment 18A could be inclined slightly relative to the perpendicular to the axis A.

In FIG. 1, it can be seen that the rotation of the cylinder block 10 relative to the casing 1A, 1B is supported by a ball bearing 5. In this example, the drive outlet of the motor is formed directly by the cylinder block which, to this end, has an external flange 10B, to which to which a member to be driven can be coupled by any suitable coupling means, e.g. by screws screwed into tapped holes 10'B. The ball bearing 5 is thus situated radially outside the cylinder block because it co-operates with the inside periphery of the portion 1B of the casing in the vicinity of the cam 16, and with the outside periphery of the external flange portion 10B. A dynamic gasket 7 provides sealing, by being retained relative to the portion 1B of the casing by a retaining ring 7'. The ball bearing takes up both the axial forces and the radial forces, and offers the advantage of being very compact axially. Naturally, it is possible to use the invention with other types of bearing, e.g. conical roller bearings.

Figure 2:
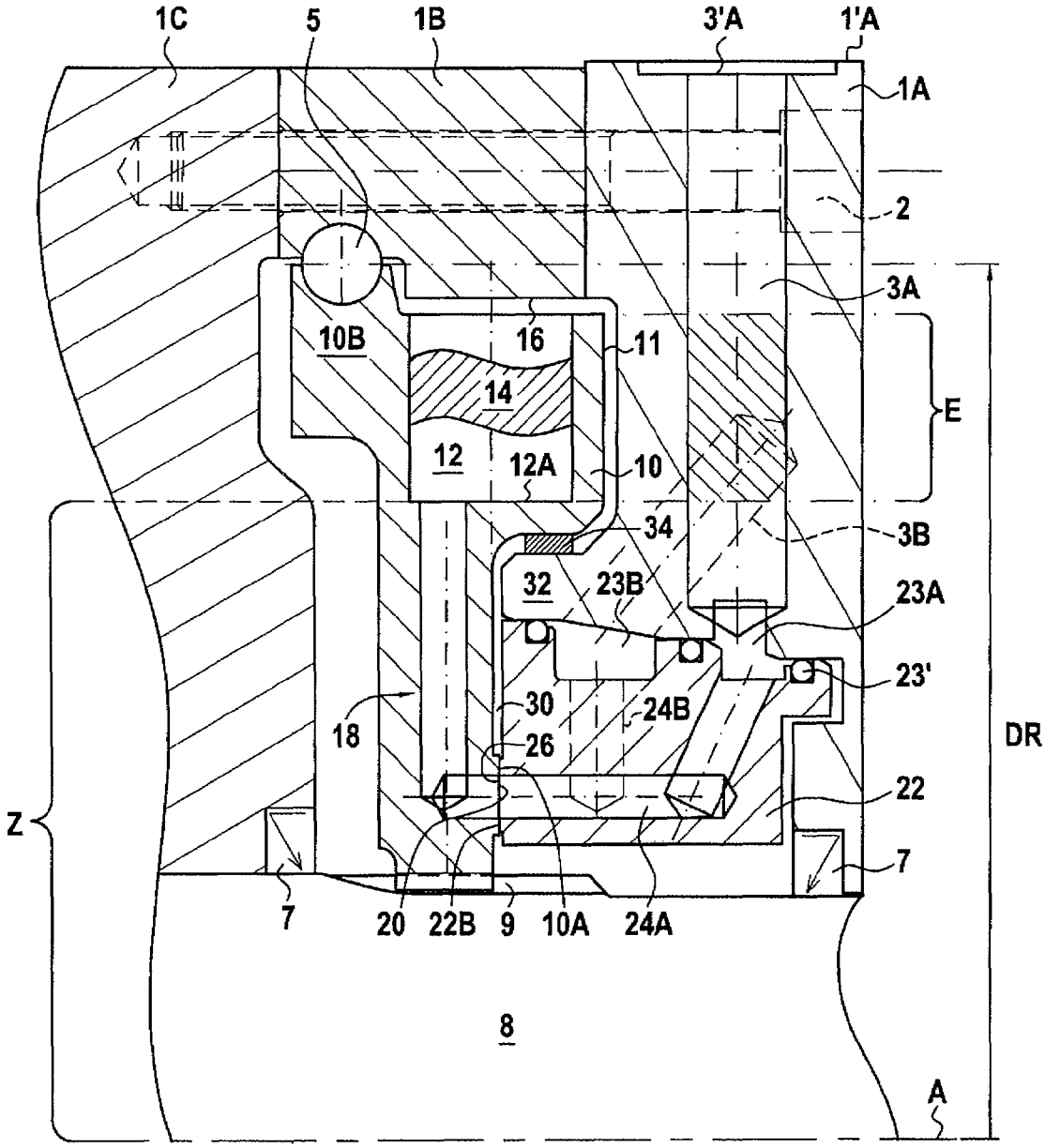
FIG. 2 is also a radial half-section view showing a variant of the mechanism of FIG. 1.

A description follows of FIG. 2, in which the elements analogous to the elements of FIG. 1 are designated by like references. In this example, the casing is in three portions 1A, 1B, and 1C that are assembled together by screws 2. The distributor 22 is analogous to the distributor of FIG. 1 and co-operates with its distribution cover formed by the portion 1A of the casing. The cylinder block 10 is also substantially analogous to the cylinder block of FIG. 1, except that the flange 10B serves merely as the support with the bearing 5, without constituting the drive outlet member of the motor. Said drive outlet member is formed by an outlet shaft 8 that co-operates with the cylinder block via fluting 9. Sealing is provided by dynamic sealing gaskets 7 disposed between the shaft 8 and, respectively, the portion 1A and the portion 1C of the casing. In this example, the shaft is a through shaft, the cylinder block 10 and the internal distributor 22 being hollow at their centers. It is also noted that the hollow 30 of the cylinder block is open on the same side as the axis of rotation A.

The bearing 5 could be replaced by any suitable bearing, e.g. a conical roller bearing disposed between the shaft 8 and the portion 1C of the casing.

Figure 3:
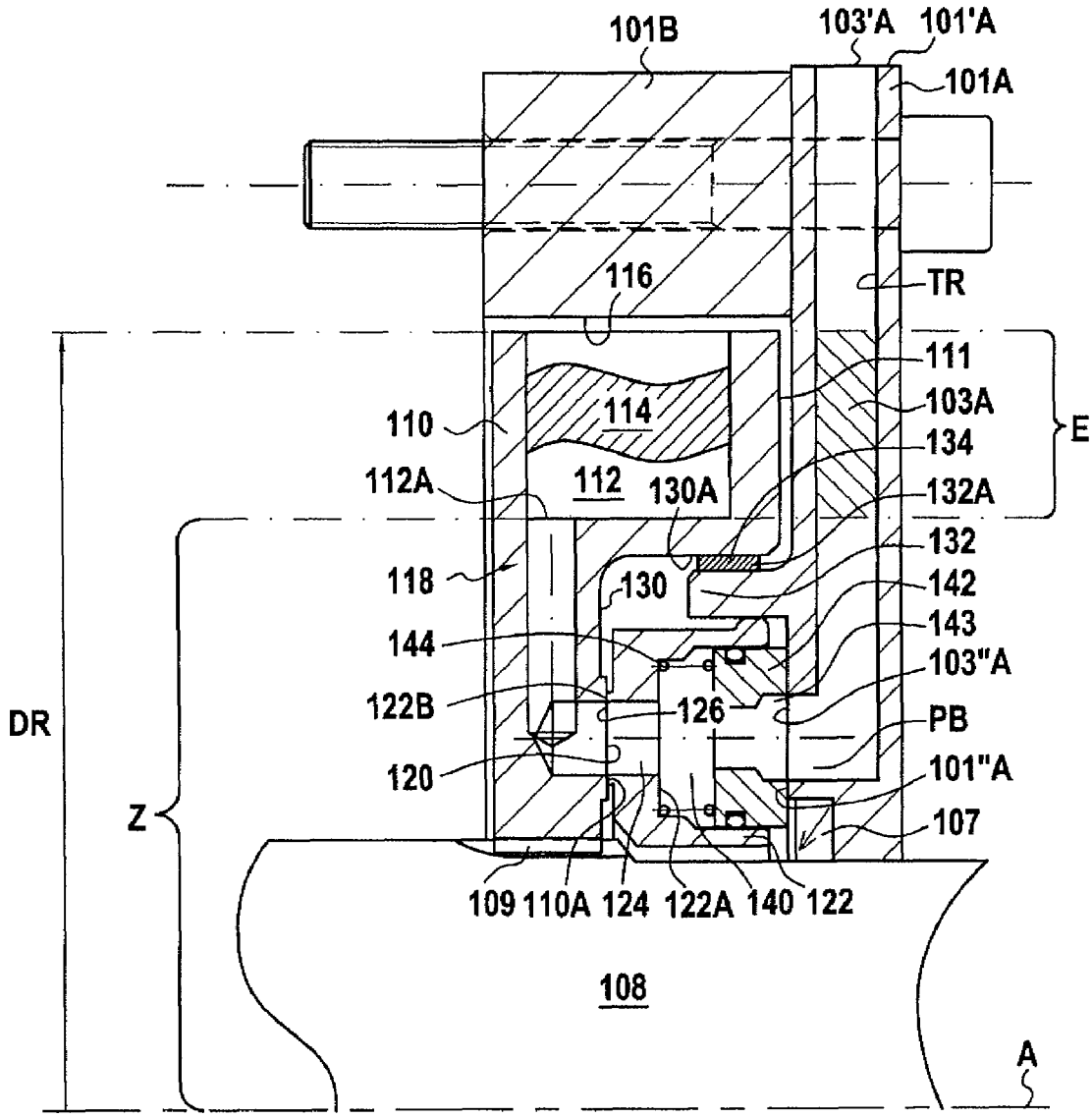
FIG. 3 is also a radial half-section view showing a second embodiment of a mechanism of the invention.

A description follows of the embodiment of FIG. 3 that differs form the preceding embodiment described with reference to FIGS. 1 and 2 by the use of a distributor of a different type. In FIG. 3, the elements that correspond to those of the preceding figures are designed by like references plus 100. For reasons of simplification, only a base portion of the motor is shown, in particular without completing the casing or showing the rotation support bearings. Thus, two casing portions are shown, respectively 101A and 101B. The cam 110 is formed at the inside periphery of the portion 101B and the portion 101A forms a distribution cover. FIG. 3 shows one of the feed or discharge ducts 103A provided in said portion 101A, which duct terminates outwardly via an orifice 103'A situated in the outside face 101'A of the distribution cover. The feed and discharge ducts pass through the zone E corresponding to the axial projection of the cylinders. The cylinder block 110 is substantially analogous to the cylinder block of FIGS. 1 and 2, with its cylinders 112, its cylinder ducts 118, its pistons 114 and the setback 130 in the transverse face 111. The communication face 110A in which the communication orifices 120 are provided is formed in the end-wall of said setback 130. Said setback 130 extends in a zone Z defined radially outwards by the end-wall portions 112A of the cylinders.

The internal fluid distributor 122 is formed by a disk provided with axial bores 124 that form the distribution ducts by passing through said disk between its connection face 122A and its distribution face 122B. The distribution orifices 126 of the bores 124 that are situated in the distribution face 122B are successively in register with the communication orifices 120 of the cylinder ducts while the cylinder blocks are rotating.

On the same side as the connection face 122A of the distributor 122, the bores 124 open into recesses 140 in which connection studs 142 are disposed that bear against the inside face 101"A of the distribution cover 101A. In this example, said inside face extends radially. A recess 140 in which a stud 142 is situated is provided for each of the bores 124. In this example, the stud is caused to bear against the inside face 101"A of the distribution cover 101A by a helical spring 144. A bore 143 passes through each stud 142, so that each stud is disposed around the orifice of a feed or discharge duct situated in the inside face 101"A of the distribution cover 101A. In this example, it can be seen that the stud 142 surrounds the orifice 103"A of the duct 103A. Taking the example of the duct 103A shown in FIG. 3, it can be understand that each of the feed and discharge ducts has a radial segment TR that extends towards the axis A from the outside face 101'A of the distribution cover 101A to a groove-forming end-wall to which there are connected a plurality of axially-extending blind bores PB; the open ends of said blind bores form the orifices 103"A of said duct that are situated in the inside face 101"A of the distribution cover 101A.

It can be seen that the disk 122 is fully received in the setback 130 of the cylinder block 110. It can also be seen that, on the same side as its inside face 101"A, the distribution cover 101A has an extension 132 that penetrates into the setback. Said extension extends around the internal distributor 122 that it contributes to wedging radially and to positioning angularly by any known means (not shown). It penetrates into the setback 130 and has a cylindrical face 132A situated facing a cylindrical face 130A of the setback 130, between which faces a rotary bearing 134 can be provided if necessary.

In this example, in FIG. 3, the drive outlet of the motor is formed by the shaft 108 that is coupled to the cylinder block 110 by fluting 109. A dynamic sealing gasket 107 disposed between the portion 101A of the casing and the shaft 108 can be seen. An analogous other gasket is disposed on the opposite side, e.g. as shown in FIG. 2.

Naturally, the embodiment shown in FIG. 3 using a distributor 122 formed by an annular disk, is entirely compatible with a direct drive by a flange of the cylinder block as shown in FIG. 1.

In the various embodiments shown, the connection orifices of the feed and discharge ducts are situated in a portion of the outside face of the distribution cover that extends substantially axially and that is situated at a distance from the axis A that is at least substantially equal to the largest radial dimension DR of the cylinder block. Thus, said connection orifices are easily accessible. They are even more easily accessible when, advantageously, they are situated in the same zone of said outside face, e.g. by being disposed on a flat.

The invention claimed is:

1. A hydraulic mechanism comprising a cylinder block that is suitable for rotating about an axis of rotation in a stationary casing and that has a plurality of cylinders in which pistons are disposed that are suitable for co-operating with a cam that is secured to or integral with the casing, the cylinders extending radially relative to the axis of rotation and being connected by cylinder ducts to communication orifices disposed in a communication face of the cylinder block that is perpendicular to the axis of rotation, a distribution cover that forms a portion of the casing, and an internal fluid distributor that is non-rotary relative to said cover, the cover having feed and discharge ducts that pass through a zone corresponding to an axial projection of the cylinders and that extend between an outside face and an inside face of said cover, the internal distributor having distribution ducts that extend between a connection face that co-operates with said inside face for the purpose of selectively connecting the distribution ducts to the feed and discharge ducts, and a distribution face that is perpendicular to the axis of rotation and that is disposed against the communication face in such a manner as to cause distribution orifices of said distribution ducts to communicate with the communication orifices while the cylinder block is rotating, a transverse face of the cylinder block being provided with an axial setback in which at least a portion of the distributor is disposed, the communication face being provided in a plane surface of said setback.

2. The mechanism according to claim 1, wherein the communication face is formed at the end-wall of the setback.

3. The mechanism according to claim 1, wherein the setback extends to a radial plane situated between two transverse planes defined by an envelope of at least some of the pistons.

4. The mechanism according to claim 3, wherein, at least for the cylinders in which said at least some of the pistons slide, the cylinder ducts have duct segments that are offset towards a side of cylinder block that is opposite from the setback relative to the axes along which pistons slide.

5. The mechanism according to claim 1, wherein the distribution cover has an extension that penetrates into the setback said extension being located on the inside face of the distribution cover.

6. The mechanism according to claim 5 wherein the extension of the distribution cover and the setback have facing cylindrical faces, between which a rotary bearing is provided.

7. The mechanism according to claim 1, wherein the connection face of the distributor has a stepped outside axial surface into which at least two axially spaced-apart grooves open out that are situated in register with respective ones of orifices of the feed and discharge ducts situated in the inside face of the distribution cover.

8. The mechanism according to claim 1, wherein the internal distributor is formed by a disk having axial bores that form the distribution ducts and that, on the same side as the connection face, open out into recesses in which connection studs are disposed that bear against the inside face of the distribution cover, around orifices of the feed and discharge ducts situated in said inside face.

9. The mechanism according to claim 8, wherein the disk is fully received in the setback.

10. The mechanism according to claim 1, wherein the setback is open on the same side as the axis of rotation.

11. The mechanism according to claim 1, wherein the feed and discharge ducts have connected orifices situated in a portion of the outside face of the distribution cover.

* * * * *